United States Patent [19]

Magovern

[11] Patent Number: 4,747,397

[45] Date of Patent: May 31, 1988

[54] FLEXIBLE PAD FOR DIRECT MYOCARDIAL TISSUE MASSAGE HAVING THUMB LOOP

[76] Inventor: George J. Magovern, 251 Old Mill Rd., Pittsburgh, Pa. 15238

[21] Appl. No.: 873,513

[22] Filed: Jun. 12, 1986

[51] Int. Cl.[4] ..... A61H 7/00; A61H 31/00

[52] U.S. Cl. ..... 128/61; 128/60; 128/67

[58] Field of Search ..... 128/61, 67, 60, 59, 128/62 R, 28, 153, 54

[56] References Cited

U.S. PATENT DOCUMENTS

| | | | |
|---|---|---|---|
| 686,638 | 11/1901 | Saffold | 128/67 |
| 1,586,031 | 5/1926 | Duncan | 128/65 |
| 1,683,410 | 9/1928 | Rancourt | 128/65 |
| 2,014,022 | 9/1935 | Klein | 128/67 |
| 3,034,501 | 5/1962 | Hewson | 128/60 |
| 3,053,249 | 9/1962 | Smith | 128/67 |
| 3,196,869 | 7/1965 | Scholl | 128/153 |
| 3,425,409 | 2/1969 | Isaacson et al. | 128/54 |
| 3,606,886 | 9/1971 | Bittner | 128/153 |
| 4,164,216 | 8/1979 | Person | 128/54 |
| 4,196,722 | 4/1980 | Vandewoude | 128/28 |
| 4,308,860 | 1/1982 | Sanders et al. | 128/62 R |
| 4,429,688 | 2/1984 | Duffy | 128/54 |
| 4,554,910 | 11/1985 | Lally | 128/54 |

FOREIGN PATENT DOCUMENTS

| | | | |
|---|---|---|---|
| 344528 | 11/1921 | Fed. Rep. of Germany | 128/60 |
| 874360 | 8/1961 | United Kingdom | 128/153 |

*Primary Examiner*—Edgar S. Burr
*Assistant Examiner*—Tonya Lamb
*Attorney, Agent, or Firm*—Webb, Burden, Robinson & Webb

[57] ABSTRACT

A surgical accessory, and method for using it, for facilitating manual cardiac massage. The device is a generally disc-shaped pad adapted to receive the thumb of the user and to append from the inner thumb surface. The pad is approximately 3–10 centimeters in diameter, 0.5–2 centimeters in width and may secure the thumb by a loop, indentation aperture or the like. The generally disc-shaped pad may be a fluid-filled, foam or solid resilient structure. In order to use the present device, the practitioner attaches the disc to the inside surface of the thumb on the hand which he or she intends to use for cardiac massage. The disc is aligned to oppose the curved surface defined by the palmar skin on the fingers. Cardiac massage is executed as usual, and the device displaces the pressure exerted by the thumb over the myocardial surface in contact with the disc. A more even pumping pressure is thus exerted, and the chances of perforating or distressing the heart with the thumb are minimized.

9 Claims, 1 Drawing Sheet

FLEXIBLE PAD FOR DIRECT MYOCARDIAL TISSUE MASSAGE HAVING THUMB LOOP

FIELD OF THE INVENTION

The invention pertains to a surgical accessory for facilitating cardiac massage, and the method for using it.

BACKGROUND OF THE INVENTION

The treatment of choice for the emergency treatment of cardiac arrest typically includes standard techniques of cardiopulmonary resuscitation, at least in the non-hospital setting. The treatment of cardiac arrest or insufficiency in the post-operative cardiac patient (recent midsternotomy) sometimes requires the more drastic reopening of the chest and the manual massage of the heart by the surgeon. To perform such a cardiac massage, the surgeon places his hand into the thoracic cavity and encircles the myocardium with his fingers and thumb. Then, by squeezing, the surgeon approximates systole and diastole as best he or she is able. This same cardiac massage technique may be required during cardiac surgery itself, at various times during the operation, during, for example, decreased cardiac output, asystole, etc.

BRIEF DESCRIPTION OF THE INVENTION

The present invention is a surgical accessory, and method for using it, for facilitating manual cardiac massage. The device is a generally disc-shaped pad adapted to receive the thumb of the user and to append from the inner thumb surface. The pad is approximately 3–10 centimeters in diameter, 0.5–2 centimeters in width and may secure the thumb by a loop, indentation aperture or the like. The generally disc-shaped pad may be a fluid-filled, foam or solid resilient structure. In order to use the present device, the practitioner attaches the disc to the inside surface of the thumb on the hand which he or she intends to use for cardiac massage. The disc is aligned to oppose the curved surface defined by the palmar skin on the fingers. Cardiac massage is executed as usual, and the device displaces the pressure exerted by the thumb over the myocardial surface contacted by the disc. An even pumping pressure is thus exerted by the thumb, and the chances of perforating or distressing the myocardium of the ventricle with the thumb are minimized.

DETAILED DESCRIPTION OF THE INVENTION

The present invention is a surgical accessory for use on the thumb of a surgeon executing cardiac massage. The accessory is a generally dis-shaped pad having a means for securing the thumb thereto. The pad is worn on the inner surface of the thumb and, because it is resilient and flexible, the pad serves to displace the pressure of the thumb over the adjacent myocardial surface.

Figure 1:
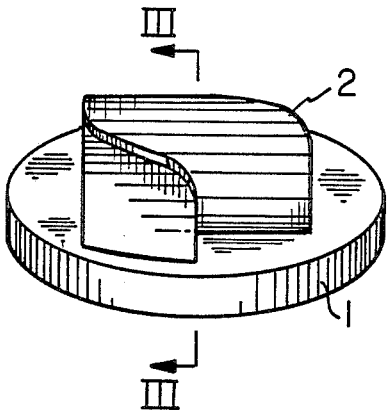
FIG. 1 is a plan view of the preferred embodiment of the invention.
Figure 3:
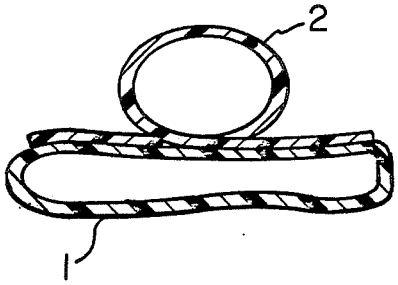
FIG. 3 is a sectional view of the preferred embodiment of the invention taken along line III—III of FIG. 1.

Referring now to FIG. 1, the preferred embodiment of the present device comprises a generally disc-shaped pad 1 and a means for securing the thumb 2. The means for securing the thumb 2 is a generally loop-shaped structure through which the thumb is passed to enable the user to grip the myocardium with the disc-shaped pad 1 appended from the inner surface of the thumb. Referring now to FIG. 3, which is a sectional view along lines III—III of FIG. 1, the generally loop-shaped means for securing the thumb 2 and the pad 1 are shown. The sectional view illustrates that in the preferred embodiment of the invention, the pad 1 is a fluid-filled pad having solid walls. Preferably, the fluid in the cavity of the hollow pad is air, although other fluids such as ethanol, polyethylene glycol, water, or mixtures thereof, may also be incorporated. Suitable materials for the preparation of the embodiment shown in FIGS. 1 and 3 include silicone resins, polyethylene and polypropylene resins, rubbers, polyester urethane resins, polyether urethane resins, urea-siloxane polymers, flexible acrylic acid copolymers and the like. Because they are the most biologically inert, however, the silicone resins and the urea-siloxane polymers are preferred.

The means for securing the thumb 2 and the generally disc-shaped pad 1 may be adjoined by means known in the art. Specifically, the means for securing the thumb may be adhered to the pad 1 with a suitable adhesive, or the two structures may be co-cured at the time of their individual manufacture. Suitable adhesives include blends of butadiene-acrylonitrile copolymers with resins such as oil-soluble, heat-hardening phenol-formaldehyde resins, two-step thermosetting phenolic resin compositions, coumarone-indene resins, polyterpene resins, and the like; polychloroprene combined with heat-hardening phenolformaldehyde resins, rosin-phenol resins, vinyl alkyl ether polymer based adhesives, thermoplastic styrene-butadiene block polymer rubbers mixed with resins such as those described; and other such adhesive compositions.

The generally disc-shaped pad of the preferred embodiment has walls which are between 0.5 and 8 millimeters thick. The pad itself is approximately 3–10 centimeters in diameter and is 0.5–2 centimeters wide. The thickness of the various remaining walls of the device may vary between 0.5 and 15 millimeters.

Figure 2:
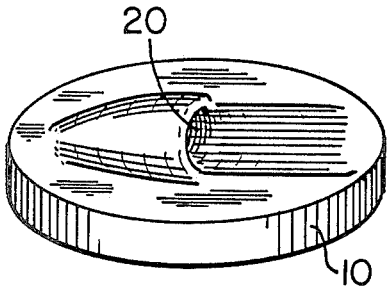
FIG. 2 is a plan view of another embodiment of the invention.

Referring now to FIG. 2, in which is illustrated a second embodiment of the invention, the generally disc-shaped pad 10 is shown having a thumb-receiving indentation/aperture 20 therein. This second embodiment of the invention as illustrated is preferably constructed of a flexible foam such as a polyethylene polyurethane foam having the indentation/aperture 20 therein as shown.

Notwithstanding their structural differences, each of the above-described embodiments of the invention functions in the same manner during use. Each of the pads 1 or 10, when positioned on the inner surface of the thumb, displaces the pressure of the thumb during cardiac massage. In other words, the pad prevents the surgeon or other practitioner from perforating or otherwise locally distressing the heart with his thumb. Embodiments of the invention which have some natural adherence to the myocardial surface (for example, mild suction) also provide some assistance to diastole during heart massage.

The manner in which the present device facilitates cardiac massage dictates that the pad can be neither extremely flexible nor extremely rigid. Extremely flexible pads do not adequately displace the pressure of the surgeon's thumb; extremely rigid pads may cause pressure trauma to the myocardium. Generally speaking, therefore, the materials used in the construction of the present device should have a Durometer A hardness between 35 and 55, or between the hardness range bounded by relatively soft rubber bands and the harder automobile tire tread rubber compositions. Furthermore, fluid pressure within the fluid-filled embodiments of the present invention should remain low enough to permit at least slight manual indentation at any point along the pad surface. Due to the nature of their inherent flexible firmness, most or all flexible polyurethane foams are suitable for use in the present invention.

Although the present device has been described as a generally disc-shaped pad having a means for securing the thumb thereon, the pad itself may be shaped in accordance with innumerable configurations. For example, squares, rectangles, triangles, etc. may be used, although they offer no advantage over the generally disc-shaped pad. The pad may further have thickened edges, a recessed thumb pouch or other indentation, and all manner of other adaptions so long as the pad surface intended for myocardial contact is flexible and predominantly smooth. The pads may contain fluid- or air-release valves if desired. Thus, although the invention has been described with reference to specific materials and specific configurations, the invention is to be limited only insofar as is set forth in the accompanying claims.

I claim:

1. A device for facilitating manual cardiac massage, comprising:

a flexible pad wherein said pad is generally disc-shaped, and wherein said pad further has a surface thereon adapted for direct contact with myocardial tissue; and a means for securing the thumb on one surface of said pad, whereby said pad provides a cushion between the thumb of the user and the tissue contacted therewith during cardiac massage.

2. The device according to claim 1 wherein said generally disc-shaped pad has a diameter between about 3 and 10 centimeters.

3. The device according to claim 2 wherein said genrally disc-shaped pad has a width between about 0.5 and 2 centimeters.

4. The device according to claim 3 wherein said means for securing the thumb is an indentation aperture.

5. The device according to claim 4 wherein said pad is a flexible foam pad.

6. The device according to claim 3 wherein said means for securing the thumb is a loop.

7. The device according to claim 6 wherein said pad is a fluid-filled pad.

8. The device according to claim 7 wherein said fluid-filled pad is an air-filled pad.

9. The device according to claim 8 wherein said air-filled pad has walls constructed of a silicone resin containing copolymer.

* * * * *